US005355196A

United States Patent [19]

Kurando et al.

[11] Patent Number: 5,355,196

[45] Date of Patent: Oct. 11, 1994

[54] MICRO COMPUTER CONTROLLED IMAGE FORMING APPARATUS

[75] Inventors: Shigeo Kurando; Hiromi Sakata; Yukio Hashimoto, all of Osaka; Hidekazu Sakagami, Hyogo; Kenzo Ono, Osaka, all of Japan

[73] Assignee: Mita Industrial Co., Ltd., Osaka, Japan

[21] Appl. No.: 105,779

[22] Filed: Aug. 12, 1993

Related U.S. Application Data

[63] Continuation of Ser. No. 795,429, Nov. 20, 1991, abandoned.

[30] Foreign Application Priority Data

Nov. 27, 1990 [JP] Japan ..... 2-327857

[51] Int. Cl.[5] ..... G03G 21/00

[52] U.S. Cl. ..... 355/206; 355/75; 355/203; 355/209; 355/233; 358/500

[58] Field of Search ..... 355/203–209, 355/233, 235, 243, 50, 51; 358/75, 78, 80; 271/3.1

[56] References Cited

U.S. PATENT DOCUMENTS

| | | | |
|---|---|---|---|
| 4,203,663 | 5/1980 | Ogura et al. | 355/203 X |
| 4,260,241 | 4/1981 | Honma et al. | 355/271 X |
| 4,343,036 | 8/1982 | Shimizu et al. | 364/518 |
| 4,690,545 | 9/1987 | Machara | 355/51 |
| 4,878,110 | 10/1989 | Maruyama et al. | 358/75 |
| 4,952,985 | 8/1990 | Kawaguchi et al. | 355/206 |
| 5,029,315 | 7/1991 | Morikawa et al. | 355/235 |
| 5,047,800 | 9/1991 | Fukumoto et al. | 355/45 |
| 5,086,309 | 2/1992 | Iida et al. | 346/160 |
| 5,105,225 | 4/1992 | Honjo et al. | 355/233 |
| 5,130,748 | 7/1992 | Tanaka | 355/206 |
| 5,239,341 | 8/1993 | Ishida et al. | 355/206 |

*Primary Examiner*—A. T. Grimley
*Assistant Examiner*—Thu Dang
*Attorney, Agent, or Firm*—Koda and Androlia

[57] ABSTRACT

An encoder is connected to the drive system of the optical system of an image forming apparatus including an optical system for exposing a document image to a light and scanning the document image, a home position switch for detecting the optical system when it comes to the vicinity of the starting position, and a resist roller for setting the feeding start timing of a transfer sheet to the transfer section, and, on reproducing the above document image on a transfer sheet, when the pulse signals coming from the encoder, which are counted from the time when the optical system passes through the home position switch, reach the appointed value, the above resist roller operates.

6 Claims, 4 Drawing Sheets

MICRO COMPUTER CONTROLLED IMAGE FORMING APPARATUS

This is a continuation of application Ser. No. 795,429, filed Nov. 20, 1991, now abandoned.

BACKGROUND OF THE INVENTION

1. Field of the invention

The present invention relates to an image forming apparatus such as a copying machine, etc. and more particularly relates to an image forming apparatus in which the adjustment of feeding start timing of a transfer sheet to the transfer section can be easily carried out.

2. Description of the prior art

In a conventional copying machine which can be an example of an image forming apparatus described above, as the optical system for exposing a document to a light and scanning the document starts scanning in an appointed scanning direction, a home position switch which is installed in the vicinity of the starting position of the optical system detects passage of the optical system. Consecutively, the timing switch which is installed at the downstream side in the scanning direction of the home position switch detects the passage of the optical system.

The fixing position of the home position switch is a certain index position at the scanning start of the optical system. The timing switch is used for synchronizing both the reading start of a document image by the optical system and the movement of the leading edge of the transfer sheet on which the document image is to be transferred. The distance between respective fixing positions of the home position switch and the timing switch is individually set on every copying machine according to the synchronization timing for synchronizing both tile reading start and the movement of leading edge of the transfer sheet.

And the copying machine is provided with a resist clutch which can intermittentably connect a resist roller to start the feeding of a transfer sheet to the transfer section with the drive source thereof. Therefore, the operation start timing of the resist clutch corresponds to the distance between the fixing positions of the respective switches.

Hence, in order to diminish dispersion of the response time of the resist clutch and dimensional dispersion of respective kinds of components, it is necessary to adjust the distance between tile fixing positions of the above switches. Then, for example, the timing switch can be installed so as to be able to move in the scanning direction, and the adjustment of the operation start timing of the resist clutch can be carried out by changing the fixing position of the timing switch.

Hence, a work for mechanically adjusting the fixing position of the timing switch to adjust the feeding start timing of the transfer sheet has been conducted, with trial and error repeated, by a skilled person having a pretty good skill as checking a document image transferred onto a transfer sheet. For this reason, the work has not been easy.

Even though the adjustment work can be done by, for example, a skilled person, it has not been possible that an adjustment work is carried out with a remarkably high accuracy and a small dispersion because the work is performed by a person.

Furthermore, it is general that such adjustment work has been set once on shipping the corresponding copying machine. Namely, the adjustment work is never performed by a user during the service life of the copying machine. Therefore, even though any gap in the synchronization timing should occur due to, for example, wearing of various kinds of components as time passes, the gap could not be corrected.

SUMMARY OF THE INVENTION

The present invention has been made to solve such problems.

It is therefore a principal object of the present invention to provide an image forming apparatus by which the adjustment of the feeding start timing of a transfer sheet to the transfer section can be accurately carried out with ease. Namely, the point of the present invention is that an image forming apparatus comprising an optical system for exposing a document image to a light and scanning the document image, a home position switch for detecting the optical system when it goes to the vicinity of the starting position, and a resist roller for setting the feeding start timing of a transfer sheet to the transfer section, and reproducing the document image onto a transfer sheet, is composed so that an encoder can be connected to the drive system of the optical system and the resist roller can be started when the pulse signals, which come from tile encoder, are counted from the time when the optical system passes through the home position switch reach an appointed value.

In an image forming apparatus according to the present invention, the encoder starts outputting pulse signals at the same time as the optical system is driven. And the pulse signals are counted from the time when the optical system passes through the home position switch in the vicinity of the starting position thereof. Then, when the pulse signals thus counted reach an appointed value corresponding to the feeding start timing of a transfer sheet to the transfer section, the resist roller for setting the feeding start timing starts. Therefore, the feeding start timing can be adjusted only with the work for changing the appointed value.

The specification hereof specifically points out the points of the present invention and ends with the claims thereof. The present invention can be well Understood by the ensuing description thereof with reference to the accompanied drawings.

DETAILED DESCRIPTION OF THE PREFERRED EMBODIMENT

Figure 1:
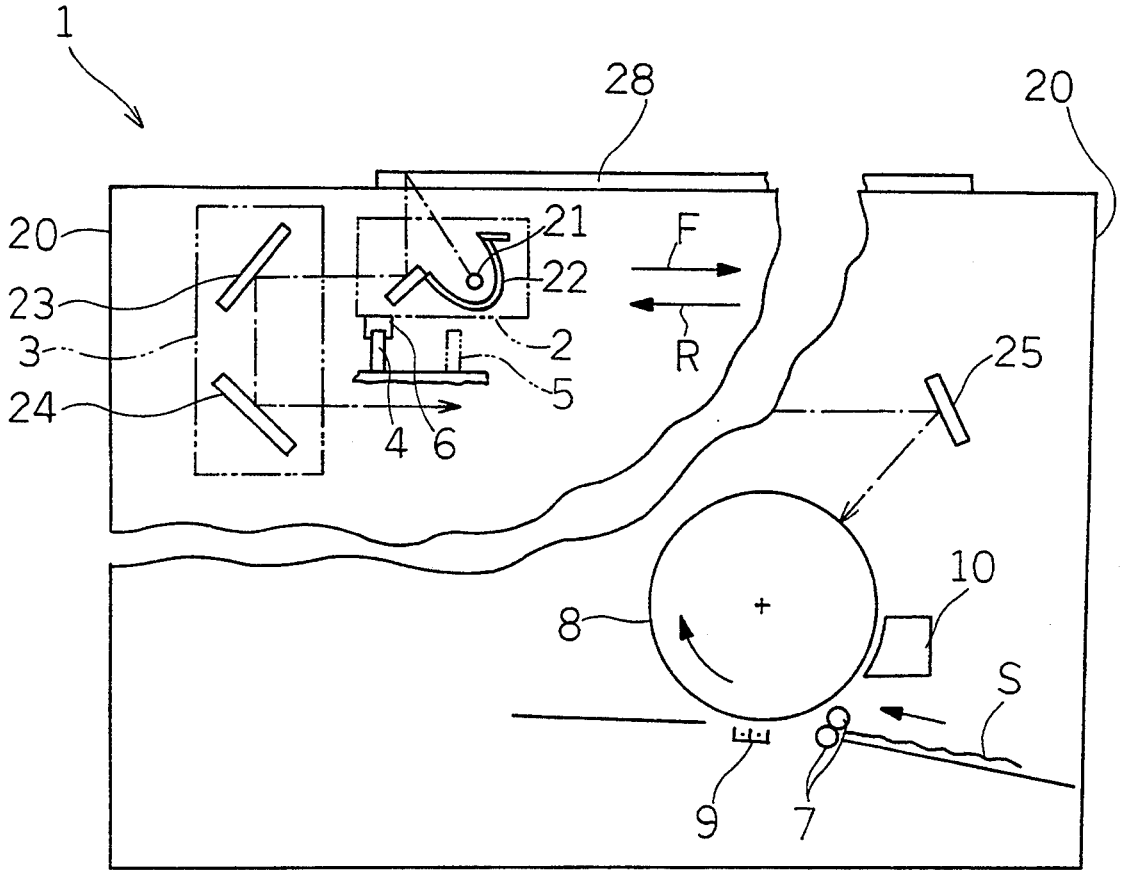
FIG. 1 is a constitutional view of the main parts of a copying machine according to a preferred embodiment of the present invention.

As shown in FIG. 1, a copying machine 1 according to a preferred embodiment of the invention is provided with the first travelling section 2 on which a light source 21 and a mirror 22 are installed for exposing and scanning a document image of a document (not illustrated) placed on the document table 28 at the upper part of the machine body 20 in the scanning direction shown with an arrow F and the second travelling section 3 on which mirrors 23 and 24 guide the image light reflected from the document to the surface of a photosensitive drum 8 by way of a mirror 25. A home position switch 4 is mounted at the machine body side below the first travelling section 2. The home position switch 4 is disengageably engaged with a detecting end 6 projecting from the underside of the first travelling section 2. When the home position switch 4 is engaged with the detecting end 6 (FIG. 1), the home position switch 4 detects that the above first travelling section 2 has come to the vicinity of the start position thereof. Namely, the actual stationary position of the first travelling section 2 is in the left side from the position of the first travelling part 2 shown in FIG. 1.

Figure 3:
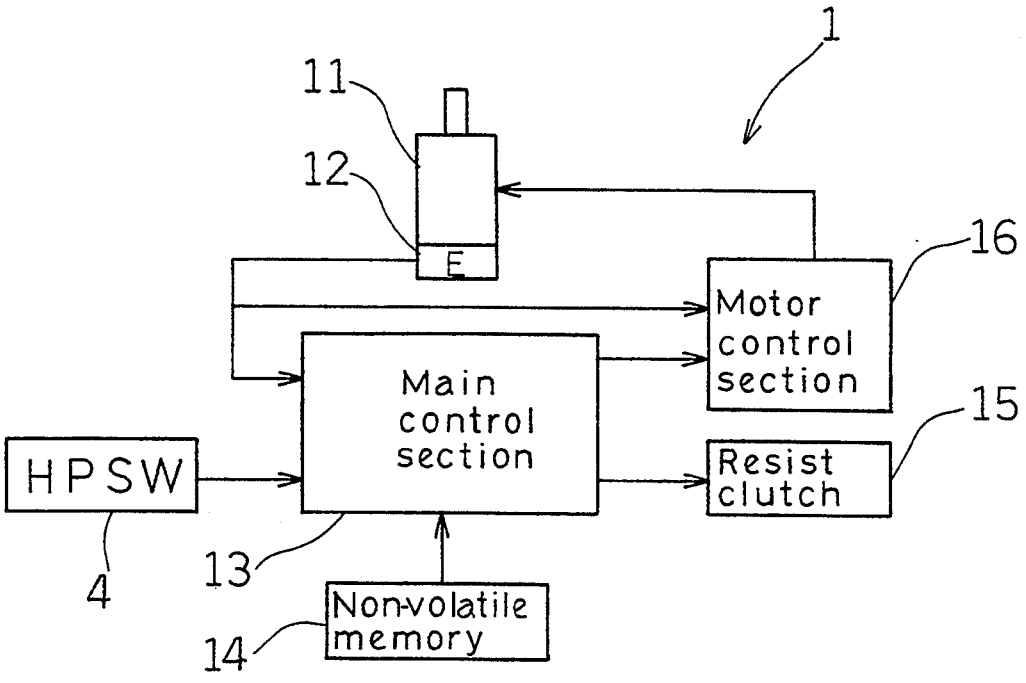
FIG. 3 is a block diagram showing the control system of the above copying machine.

On the other hand, a developer 10 to develop the electrostatic latent image formed on the surface of the photosensitive drum 8 for the document image as toner image, a pair of the resist rollers 7 to set the feeding start timing of the transfer sheet S, and a transfer and separation charger 9 as transfer section to transfer the toner image on the photosensitive drum 8 onto a transfer sheet S and to separate the transfer sheet S from the photosensitive drum 8 after the transfer is completed are disposed at the surrounding of the above photosensitive drum 8. The above resist rollers 7 are intermittentably connected to the drive source (not illustrated) by way of the resist clutch 15 (FIG. 3) and are driven and rotated by operation of the above resist clutch 15.

Figure 2:
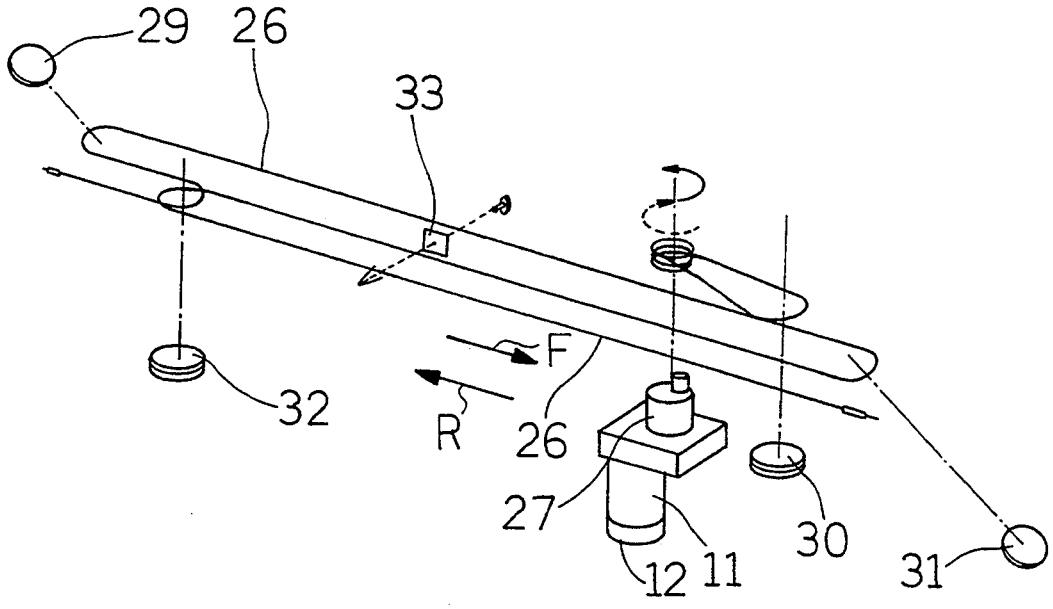
FIG. 2 is a perspective view showing the wire composition and the drive section to drive the optical system of the above copying machine.

And a wire 26 to reciprocate the first traveling section 2 and the second travelling section 3 in the direction of arrows F and R is, as shown in FIG. 2, installed by being wound on the pulleys 29 through 31 rotatably installed at the body side, respectively. The above wire 26 can run by drive and rotation of the drive pulley 27 connected to the drive shaft of a motor 11. And the first travelling section 2 is fixed at a part of the wire 26 by a fixing member 33. Moreover, the second travelling section 3 is supported by the axis of an idle pulley 32 to which the wire 26 is wound, so that the second travelling section 3 can move in the direction of arrows F and R, and it is so composed that the second travelling section 3 can move over a half distance of movement of the first travelling section 2 at a half speed thereof.

Furthermore, an encoder 12 is directly connected to the drive shaft of the motor 11 opposite to the drive pulley 27. However, the encoder 12 is not limited to be connected to the drive shaft of the motor 11 and, instead thereof, can be connected to the rotation axis of, for example, the pulleys 29 through 31 which can constitute the drive system together with the motor 11.

And the resist clutch 15 and the motor control section 16 to control the rotation of the motor 11 are connected to the signal output side of the main control section 13 which is mainly composed of a micro computer, and the home position switch 4, the encoder 12 and the non-volatile memory 14 are connected to the signal input side of the main control section 13.

In the above non-volatile memory 14, an appointed value of the above pulse signals for setting an adequate feeding start timing of the transfer sheet S is rewritably memorized, so that the leading edge of the document image as toner image on the photosensitive drum 8 and the leading edge of the transfer sheet S can be synchronized each other. The appointed value of the pulse signals can be inputted and set in advance by using a keyboard (not illustrated) of the machine body 20 and is stored in the non-volatile memory 14. Furthermore, in the preferred embodiment, the value of 5 which has been obtained through simple trial and error is set as the appointed value.

Still furthermore, the main control section 13 starts counting the pulse signals from the encoder 12 when the first travelling section 2 begins to move from the above actual stationary position and the detection end 6 thereof passes through the .above home position switch 4, and it outputs the operation command signal to the resist clutch 15 when the counted value of the pulse signals reaches the appointed value (5).

A copying machine 1 according to the preferred embodiment of the present invention is composed so as to be described above.

Figure 4:
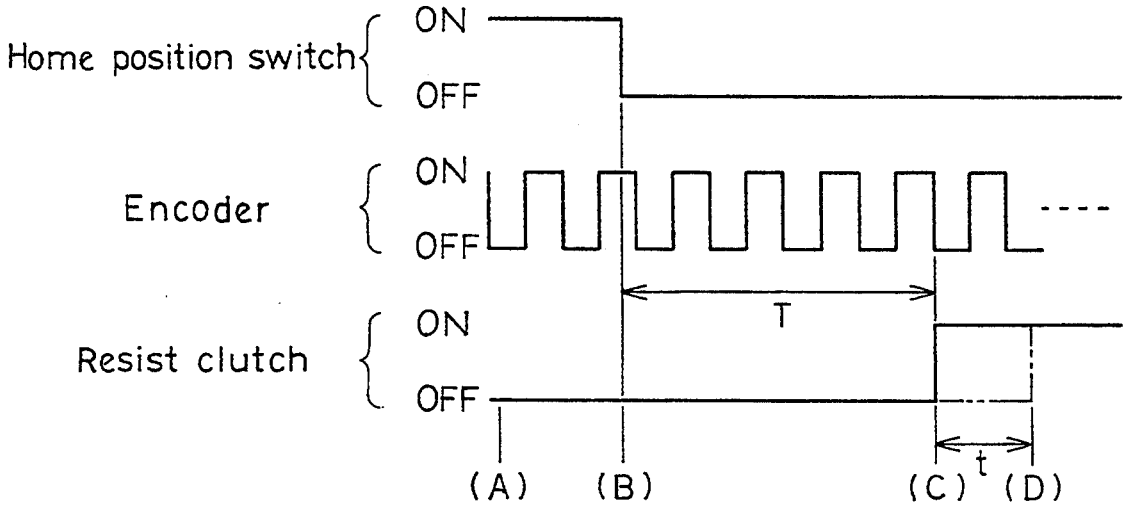
FIG. 4 is a time chart showing the movements of the above copying machine.

Hence, the actions of the copying machine 1 are described with reference to the timing chart of FIG. 4.

Firstly, as the first travelling section 2 starts scanning from the above stationary position by drive of the motor 11, the encoder 12 outputs pulse signals toward the main control section 13. And as the detection end 6 of the first travelling section 2 is engaged with the home position switch 4 (Time "A"), it is detected that the first travelling section 2 has come to the vicinity of the starting position, and the home position switch 4 outputs the detection signal toward the main control section 13.

Consecutively, from the time when the first travelling section 2 passes through the home position switch 4 and the home position switch 4 stops outputting (Time "B"), the main control section 13 counts the downstroke of the pulse signals from the encoder 12. And when the counted value of the pulse signals reaches the appointed value (5) (Time "C"), the above main control section 13 outputs an operation command signal to the resist clutch 15 and actuates the resist clutch 15, thereby causing the resist roller 7 to be started and causing the transfer sheet S to be fed between the photosensitive drum 8 and the transfer and separation charger 9 at a proper feeding start timing. Thus, the toner image corresponding to the document image on the photosensitive drum 8 is transferred onto the transfer sheet S with the leading edge of the transfer sheet S and the leading edge of the document image synchronized. Consecutively, the toner image is fixed by a fixing process (not illustrated), thereby causing the document image to be reproduced on the transfer sheet S.

Furthermore, in the preferred embodiment, the resist roller 7 is composed so that it can be started at the same time as the counted value of the pulse signals reaches the appointed value (5). However, for example, as shown in FIG. 4, the resist roller 7 can be started at the time "D" elapsed by an appointed period of time t after the pulse signals reach the appointed value (Time "C").

Thus, The period of time "T" between the time "B" and the time "C" corresponds to the time during which the first travelling section 2 scans at a constant speed between the fixing position of the home position switch 4 and the fixing position of a conventional timing switch 5 imaginarily shown with the two-dashed line in FIG. 1. Therefore, by properly changing the appointed value of the pulse signals, it is possible to carry out the adjustment of the feeding start timing of a transfer sheet S, which is equivalent to the case as well as accurately changing and adjusting the fixing position of the conventional timing switch 5 with mincing steps. Furthermore, in a different view, for example, as the travelling distance of the first travelling section 2 is constant per pulse of the encoder 12 interlocked with the scanning speed even though the scanning speed is changed, tile distance over which the first travelling section 2 travels in at the period of time "T" corresponds to the distance between the fixing position of the home position switch 4 and the fixing position of the conventional timing switch 5 imaginarily shown in the Figure, regardless of the scanning speed. Therefore, the adjustment of the feeding start timing of the transfer sheet S to the transfer section can be accurately carried out, regardless of equal or different magnification, in each of which the scanning speed is different.

Furthermore, such adjustment work of the feeding start timing of the transfer sheet S can be executed only with key operation by which a user sets and inputs a newly appointed value by the key board and write it down for renewal in a non-volatile memory 14. Therefore, the adjustment work is remarkably easy.

Furthermore, in the preferred embodiment, change of the appointed value of pulse signals can be carried out by inputting through the key board. Instead thereof, for example, a dip switch having a plurality of pins can be used and the appointed values having different numbers may be assigned to each of the pins thereof. In this case also, the appointed value can be changed easily by a user's selection of either pin.

The present invention can be carried into effect or embodied in different embodiments, without deviating from the spirits and substantial features thereof.

Therefore, though the above embodiment is a preferred embodiment, the present invention is not limited to the above preferred embodiment.

It can be easily understood that all the modifications which can be produced in the scope of the invention shown the claims described hereinafter and in the scope meant by the claims hereof are included in the claims hereof.

What is claimed is:

1. An image forming apparatus including an optical system for exposing a document image to a light and scanning the document image, two motors, one of said two motors for driving said optical system and another one of said two motors for driving a photosensitive drum of said image forming apparatus, a home position switch for detecting the optical system when it comes to a vicinity of a starting position, and a resist roller for setting a feeding start timing of a transfer sheet to a transfer section, and reproducing the document image onto a transfer sheet, said image forming apparatus further comprising:

an encoder which generates pulse signals from a time when the optical system passes through the home position switch, said encoder being connected to the drive motor of the optical system so as to count an amount of movement of the optical system from the home position, a timing counting means for counting pulses from the encoder from a time when the optical system passes through the home position switch to a time when the resist rollers starts to feed a transfer sheet, and a timing setting means for setting the actual timing counted by the timing counting means on each actual machine from a time when the optical system passes through the home position switch to a time when the resist rollers starts to feed a transfer sheet.

2. A transfer sheet feeding start timing adjusting method of an image forming apparatus comprising an optical system for exposing a document image to a light and scanning the document image, two motors, one for driving said optical system and another for driving a photo-sensitive drum of the image forming apparatus, a home position switch for detecting the optical system when it comes to a vicinity of a starting position, and a resist roller for setting a feeding start timing of a transfer sheet to a transfer section, and reproducing the document image onto a transfer sheet, being characterized in that the method is composed so that an encoder which generates pulse signals from a time when the optical system passes through the home position switch is connected to the drive motor of the optical system so as to count an amount of movement of the optical system from the home position and the resist roller is started when the pulse signals which come from the encoder reach a preset appointed value.

3. An image forming apparatus claimed in the claim 1, wherein the encoder is directly connected to a drive shaft of the motor for driving the optical system.

4. An image forming apparatus claimed in the claim 1, wherein a key board is included to be used for changing the appointed value of the pulse signals.

5. An image forming apparatus claimed in the claim 1, wherein a dip switch is included to be used for changing the appointed value of the pulse signals.

6. An image forming apparatus claimed in the claim 1, wherein the resist roller can be started at the time elapsed by an appointed period of time after the pulse signals from the encoder reach the appointed value.

* * * * *